US006149463A

United States Patent [19]

Hashizawa et al.

[11] Patent Number: 6,149,463

[45] Date of Patent: Nov. 21, 2000

[54] SHIELDED CONNECTOR FOR DIRECT INSTALLATION FOR DEVICE

[75] Inventors: Shigemi Hashizawa; Hidehiko Kuboshima, both of Shizuoka; Kazuyuki Shiraki, Aichi; Kouichi Shirouzu, Aichi; Toshio Asahi, Aichi, all of Japan

[73] Assignee: Yazaki Corporation, Tokyo, Japan

[21] Appl. No.: 09/207,279

[22] Filed: Dec. 8, 1998

[30] Foreign Application Priority Data

Dec. 9, 1997 [JP] Japan ..... 9-338694

[51] Int. Cl.[7] ..... H01R 13/648

[52] U.S. Cl. ..... 439/607; 439/939

[58] Field of Search ..... 439/607, 609, 439/939, 92, 97, 931

[56] References Cited

U.S. PATENT DOCUMENTS 5,344,341 9/1994 Yoshino ..... 439/607

FOREIGN PATENT DOCUMENTS 8-64306 3/1996 Japan .

*Primary Examiner*—Lincoln Donovan
*Assistant Examiner*—Javaid Nasri
*Attorney, Agent, or Firm*—Armstrong, Westerman, Hattori, McLeland & Naughton

[57] ABSTRACT

A shielded connector for direct installation for a device includes an insulating housing body; a flange of the insulating housing body, which is to be assembled with a device so that the insulating housing body is shield-connected to the device, the flange being entirely covered with a conductive plated layer; and a conductive contact plate deposited on the conductive plated layer on the first principal surface side of the flange and having an elastic contact piece to be brought into contact with the device on the second principal surface side of the flange. In this configuration, the flange of the housing body can be surely connected to the device for its grounding.

20 Claims, 5 Drawing Sheets

SHIELDED CONNECTOR FOR DIRECT INSTALLATION FOR DEVICE

BACKGROUND OF THE INVENTION

1. Field of the Invention

The present invention relates to a shielded connector, and more particularly to a shielded connector for direct installation for a device in which a flange of a housing body can be connected to ground through a conductive plated layer and an elastic contact piece.

2. Description of the Related Art

FIGS. 8–9 show a conventional shielded connector for direct installation for a device which is disclosed in JP-A-8-64306.

Such a shielded connector, generally 61, as shown in FIG. 8, includes a connector housing of synthetic resin, a flange formed integrally to a stem of the connector housing 62, a contact piece 65 for grounding arranged along an attaching seat 64 of the flange 63 and a terminal plate 66 protruded from the center of the flange 63.

As shown in FIG. 9, the terminal plate 66 is composed of a female terminal 67, which is arranged within the connector housing 62, and a metallic shell 69 for shielding attached to the outside of a housing inner wall 68 surrounding the female terminal 67. The contact piece 65 protrudes from the stem of the metallic shell 69. The flange 63 is bolted to an outer wall 71 of a device through a water-proof packing 70, and the contact piece 65 is also kept in contact with a grounding conductor 72 on the side of the device so that electric noise in the connector housing 62 is bypassed to the side of the device, or the electric noise on the side of the device is bypassed externally via a complementary connector (not shown) from the metallic shell 69.

However, in the conventional configuration described above, in which the metallic shell 69 is accommodated within the connector housing 62, the connector 61 itself is large-scaled. In addition, because of the constraint of an attachment space of the metallic shell 69 and an extending direction of the terminal plate 66 (leading direction of a wire), the metallic shell 69 cannot cover the inner wall of the housing completely.

This may make the shape of the metallic shell 69 complicate and deteriorate the operability of assembling. Further, where the attaching seat 64 of the flange 63 of synthetic resin becomes deformed under the influence of heat from the device or elastic counter force of the water-proof packing 70, the holding capability of the attaching seat 64 for the contact piece 65 is deteriorated. In this case, the contact capability between the contact piece 65 and the grounding conductor 72 may become worse to deteriorate the shielding capability.

SUMMARY OF THE INVENTION

An object of the invention is to provide a shielded connector which can avoid the large-scaling of a connector itself and complication of the structure of a metallic shell and attendant deterioration of assembling capability, and assure grounding connection between the flange which may be easily deformed and a device.

In order to attain the above object, in accordance with the present invention, there is provided a shielded connector for direct installation for a device comprising: an insulating housing body having a flange; the flange grounding-connected to a device; a first and a second conductive layer deposited on a first and a second principal surface, which are opposite to each other, of the flange.

In this configuration, since the flange is connected to the device through both the conductive plated layer and elastic contact piece, the grounding passage is increased to improve the reliability of grounding connection. Even if the flange is deformed, the conductive plated layer is partially in contact with the device, and the elastic contact piece remains in contact with the device because of its elastic force, thereby keeping a grounding connection. Further, if the entire housing body is plated with the conductive layer, a metallic shell is not required so that large-scaling of the connector itself and complication of the metallic shell and deterioration of assembling capability can be avoided.

The above and other objects of the present invention will become more apparent from the following description taken in conjunction with the accompanying drawings.

DESCRIPTION OF THE PREFERRED EMBODIMENTS

Now referring to the above drawings, an explanation will be given of several embodiments of the present invention.

FIGS. 1 to 4 illustrate an embodiment of a shielded connector for direct installation for a device according to the present invention.

Figure 1:
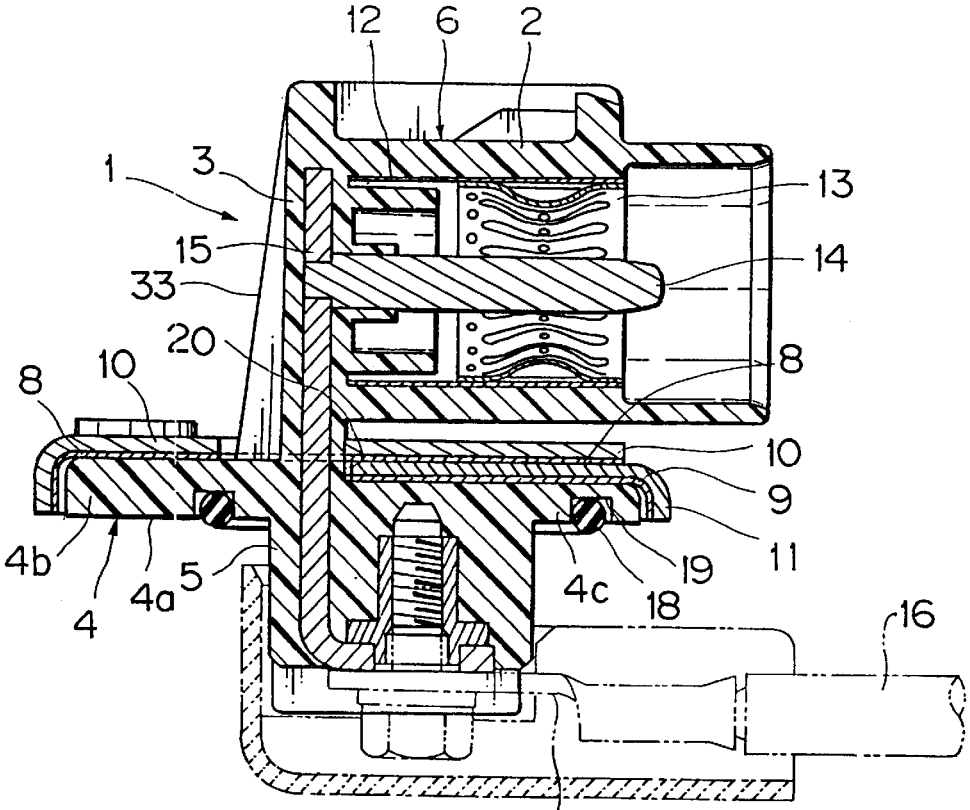
FIG. 1 is a longitudinal sectional view showing an embodiment of a shielded connector directly installed for a device according to the present invention (i.e. a sectional view taken in line A—A of FIG. 2)
Figure 2:
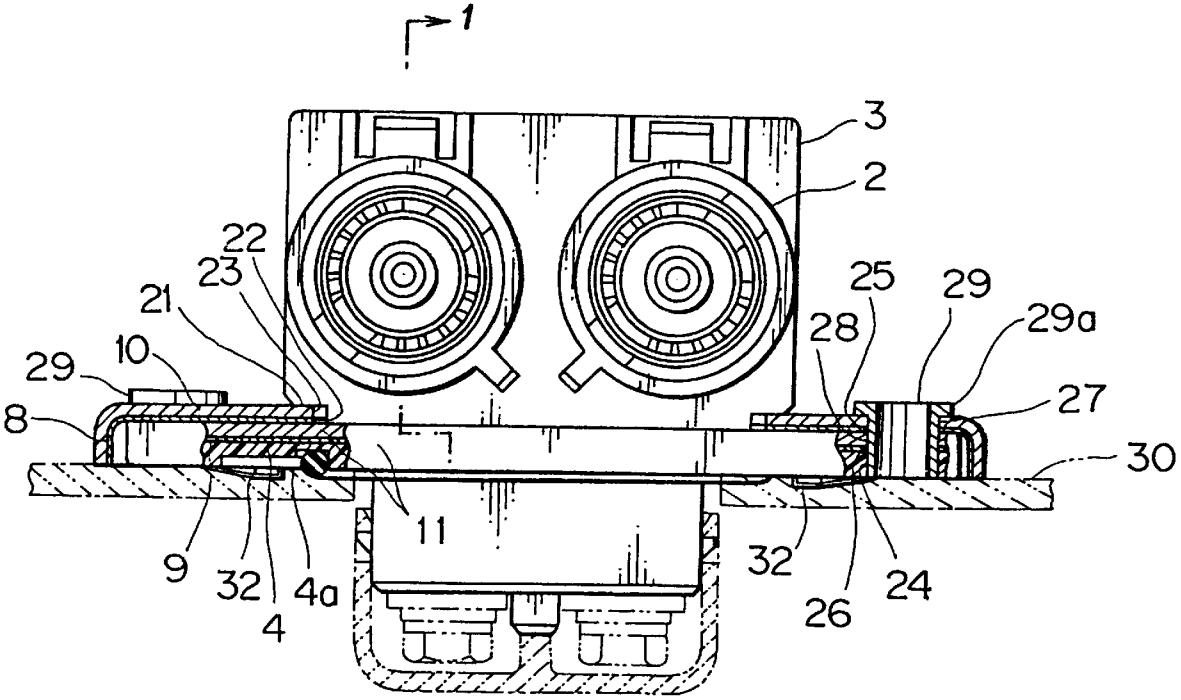
FIG. 2 is a front view of the state where the shielded connector is assembled with a device.

As shown in FIGS. 1 and 2, a shielded connector, generally 1, includes a housing body 6, which includes a pair of cylindrical connector housings 2, a vertical wall 3 from which the connector housings 2 protrude, a flange 4 from which the vertical wall 3 is uprighted, a housing body 6 of synthetic resin and a stand 5 successive to the lower side of the flange 4; a conductive (preferably plated) layer 7 formed on the front and back surface of the housing body 6, metallic contact plates (shield plates) 8, 9 deposited on the surface of the flange 4; and thick metallic reinforcement plates 10, 11 deposited on the contact plates 8 and 9.

As seen in FIG. 1, taken in line A—A in FIG. 2, a metallic shield ring 12 is fit on the inner wall of the connector housing 2, and a shield contact 13 is fit inside of the shield ring 12. A pin-like male terminal 14 is centrally disposed within the shield ring 12 to protrude from the vertical wall 3 and to be connected to a bus bar 15 therein. The bus bar 15 is bolted to the terminal 17 on the side of the wire 16. An O-ring 18 serving as a water-proof packing is mounted in a peripheral groove 19 in the back surface 4*a* (attachment seat) of the flange 4.

The flange 4 has a front half 4*c* and a rear half 4*b* which is vertically higher than the front half to form a level difference portion 20 therebetween with respect to the boundary of the vertical wall 3. On the surface of the front half 4*c* of the flange, a thin sub-contact plate 9 is deposited, and on the thin sub-contact plate 9, a thick reinforcement plate 11 is deposited. On the rear half 4*b* of the flange 4, a thin main contact plate 8 is deposited. The main contact plate 8 is kept in contact with the surface of the sub-reinforcement plate 11, and a thick main reinforcement 10 is deposited on the main contact plate 8.

Each reinforcement plate 10, 11 serves to prevent deformation of the flange 4. In addition, the reinforcement plate 10, 11 serves to prevent the remove-up of the thin contact plate 8, 9 so that the contact plate 8, 9 is in pressure-contact with the conductive plated layer 7 (FIGS. 5 and 6) of the flange 4. The front/back surfaces of the flange 4 is plated with a conductive layer. The conductive plated layer 7 is preferably made of copper and tin.

As seen from FIG. 2, the main or first contact plate 8 and the main or first reinforcement plate 10 are prevented from being lifted by fitting the inner edges of the plates in the horizontal guide groove 21 on the side of the lower end of the vertical wall 3, thereby providing strong contact force between the plates 8 and 10 and between the flange 4 and them.

At predetermined positions of the flange 4, contact plate 8, 9, reinforcement plate 10, 11, and collar passing-through holes 24–28 are concentrically formed respectively. A metallic collar 29 is press-fitted in the collar passing-through holes 24 to 28. Thus, the collar 29 is communicated with the plate 8, 9, 10, 11 and conductive plated layer 7 of the flange 4. Further, the collar 29 is brought into contact with a grounding conductor on the side of the device 30 and bolted therewith so that it can have an improved property of grounding connection. The collar 29 has an upper flange portion 29*a* which serves to receive a bolt and press the device. By press-fit of the collar 29, the contact plate 8, 9 and reinforcement plate 10, 11 are completely locked, and are secured to the device 30, together with the flange 4, by a bolt (not shown) passing through the collar 29.

On the side of the attaching seat 4*a* of the flange 4, an elastic contact piece 31, 32 (FIG. 4) integral to the contact plate 8, 9 is formed. The elastic contact piece 31, 32 is brought into elastic contact with the grounding conductor on the side of the device 30 so that it can have an improved property of grounding connection. The conductive plated layer 7 on the back surface of the flange 4 is also brought into contact with the grounding conductor. Both conductive plated layer 7 and elastic contact piece 31, 32 assure grounding conduction.

The shielding passage is realized simultaneously in two passages: a first passage of a shield contact 13→shield ring 12→connector housing 2→vertical wall 3→contact plate 8, 9→elastic contact piece 31, 32 of the contact plate 8, 9→device 30 and a second passage of a shield contact 13→shield ring 12→connector housing 2→vertical wall 3→conductive plated layer 7 of the flange 4→device 30. This always assures grounding connection with no variation due to time passage.

Figure 3:
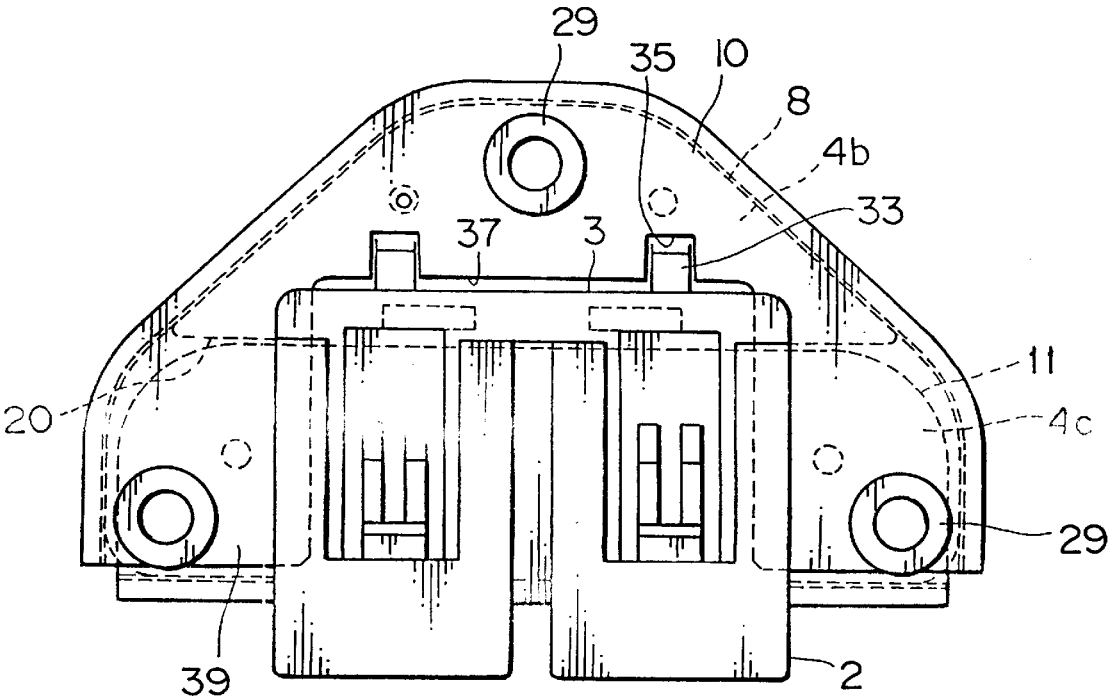
FIG. 3 is a plan view showing the shielded connector, viewed from above.
Figure 4:
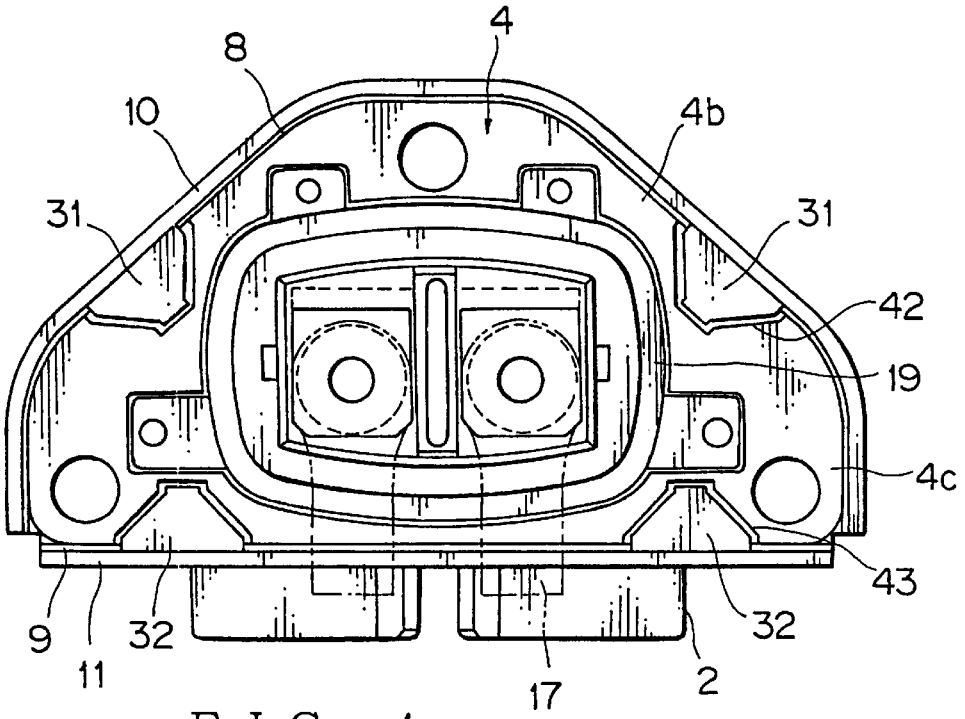
FIG. 4 is a plan view showing the shielded connector, viewed from below.

As shown in FIGS. 3 and 4, the flange 4 is composed of the rear half 4*b* having a trapezoidal shape and the front half 4*c* having a rectangular shape. The collar 29 is inserted in the flange 4 at the center of the rear end and at both sides of the front end. The vertical wall 3 has a pair of ribs 33. Correspondingly, the main contact plate 8 and main reinforcement plate 10 have rib-relief grooves 34, 35. The ribs 33 and the rib-relief grooves 34, 35 are engaged with each other to position the plate 8, 10.

The main contact plate 8 and main reinforcement plate 10 have square recesses 36 and 37 (FIG. 5) which can slip on the vertical wall 3. The plate portion 38, 39 on both sides of the recess extends to the front end of the flange 4. The sub-contact plate 9 and sub-contact reinforcement plate 11 are fit from the front end of the flange 4 to the vertical wall 3 in a connector fitting direction. Both plates 9 and 11 which are rectangular entirely cover the front half 4*c* of the flange 4 below the connector housing 2. Each contact plate 8, 9, which is kept in intimate contact with the lower face of each reinforcement plate 10, 11, operates as a shield member.

As seen from the back surface of the flange 4, a pair of elastic contact pieces 31 of the main contact plate 8 and a pair of elastic contact pieces 32, which are in contact with the attaching seat 4*a* of the flange 4, are arranged at four points on the periphery of the flange 4. Each contact plate 8, 9 is sandwiched between the main wall (upper wall) 40, 41 (FIG. 5) of each contact plate 8, 9 and each elastic contact piece 31, 32. Thus, each contact plate 8, 9 is provisionally engaged with the flange 4. The flange 4 has an engagement groove 42, 43 corresponding to each elastic contact piece 31, 32. The inner face of the engagement groove 42, 43 is also plated with a conductive layer (FIG. 7). Even if the flange 4 is thermally deformed, it can be surely brought into contact with the device 30 (FIG. 2) through the elastic contact piece 31, 32.

The peripheral wall 44 (FIG. 6) of the main contact plate 8 and the rear end wall 45 of the sub-contact plate 9 are kept in contact with the periphery of the flange 4 (FIG. 4). The peripheral wall 46 (FIG. 5) of the main reinforcement plate 10 is superposed on the peripheral wall 44, and the rear wall 47 (FIG. 5) of the sub-reinforcement plate 11 is superposed on the rear end wall 45. In FIG. 4, reference numeral 19 denotes a peripheral groove for fitting an O-ring, and 17 denotes a terminal.

Figure 6:
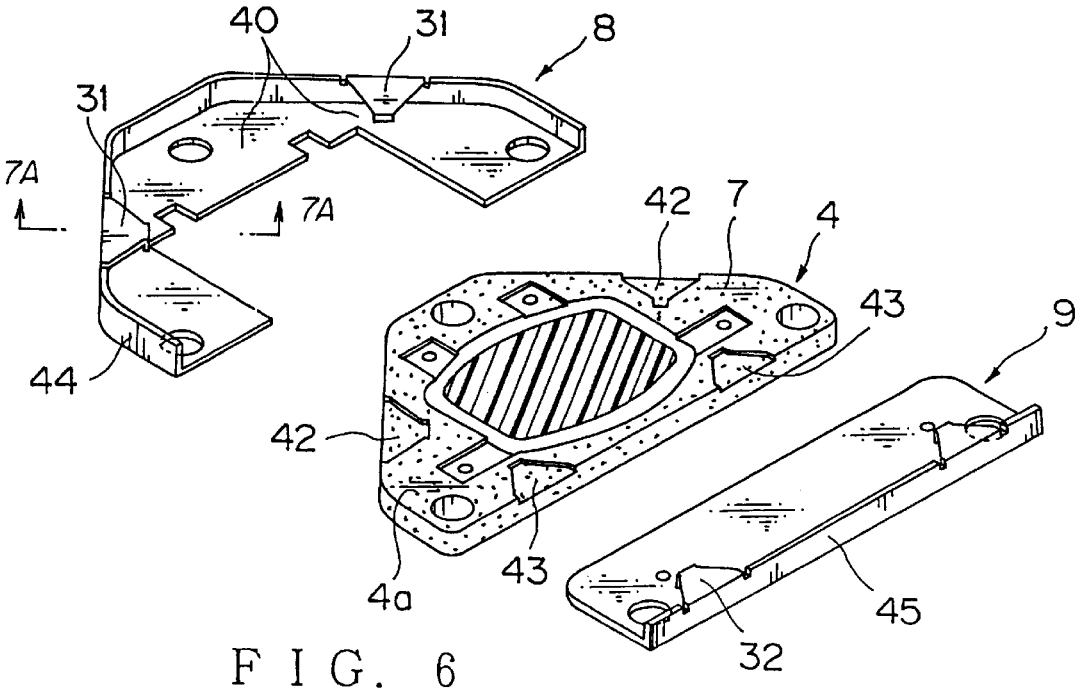
FIG. 6 is an exploded perspective view showing the shapes of the back side of the flange and each of the contact plates.
Figure 5:
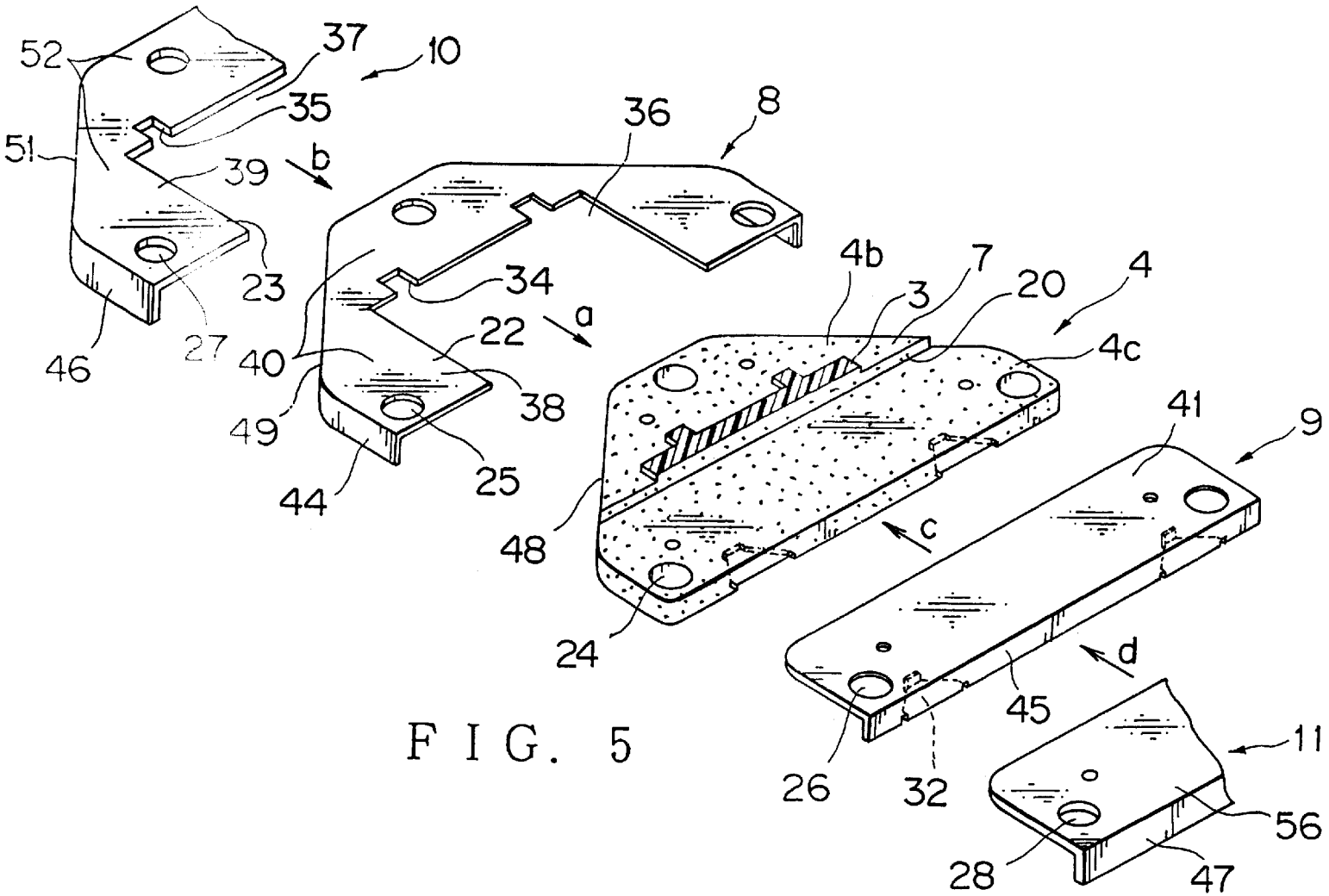
FIG. 5 is an exploded perspective view of the flange, each of contact plates and each of reinforcement plates.
Figure 9:
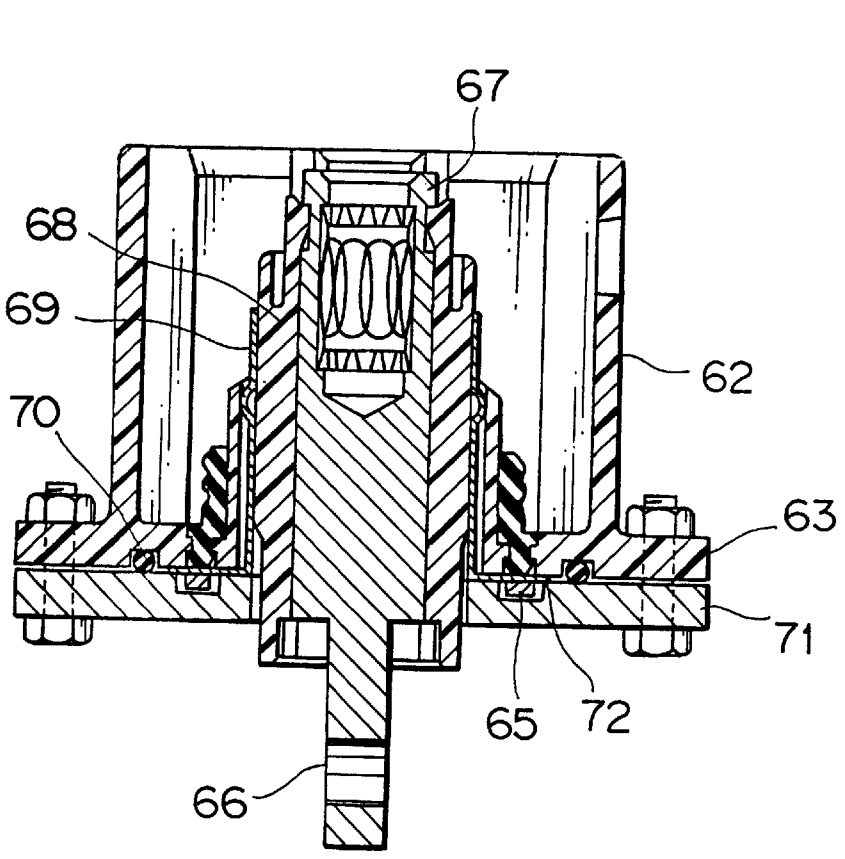
FIG. 9 PRIOR ART
FIG. 9 is a longitudinal sectional view of the conventional shielded connector.
Figure 8:
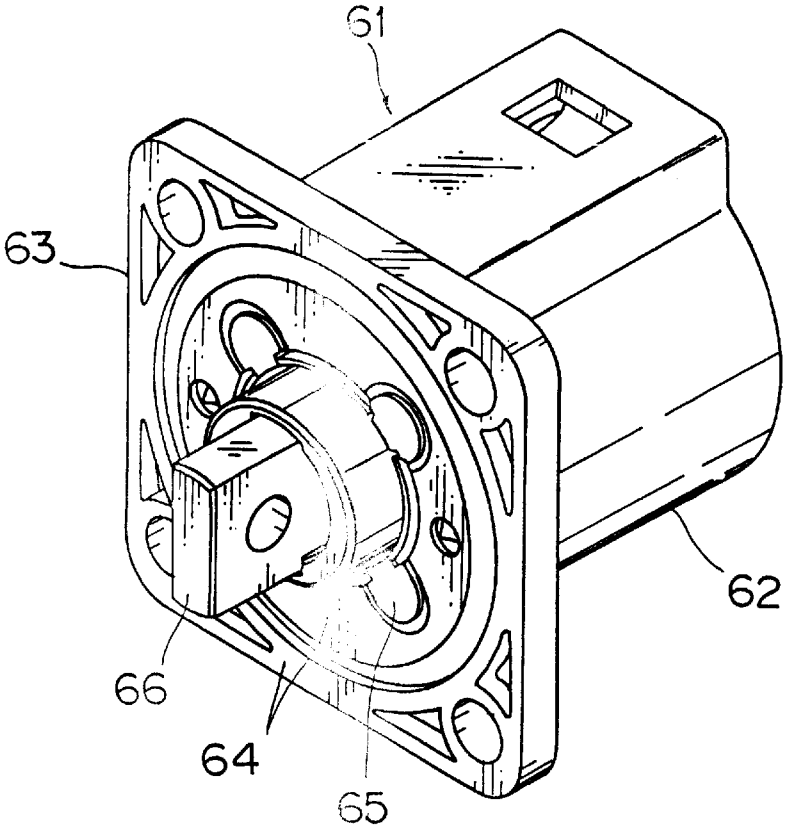
FIG. 8 PRIOR ART
FIG. 8 is a perspective view of a conventional shielded connector.

FIG. 5 shows the front side of the flange 4, each contact plate 8, 9 and each reinforcement plate 10, 11. FIG. 6 shows the back side of the flange 4 and each contact plate 8, 9. The shape of the back side of each reinforcement plate 10, 11 is substantially the same as that of each contact plate 8, 9 except for the absence of the elastic contact piece 31, 32.

In FIG. 5, the main plate 8 is formed to have a size slightly larger than the flange 4 so that the former can be fit over the latter, and the main reinforcement plate 10 is formed to have a size slightly larger than the main contact plate 8 so that the former can be fit over the latter. The rear half 4*b* of the flange 4 is formed in a trapezoid shape having tapered regions 48 on both sides. The main contact plate 8 is guided by the tapered regions 48 so as to be smoothly fit over the flange 4 from back as indicated by arrow a. The main reinforcement plate 10 is smoothly fit over the main contact plate 8 along its tapered regions 49 as indicated by arrow b. The front and back surfaces of the flange 4 is plated with a conductive layer 7 (indicated by a large number of dots).

The main contact plate 8 is composed of a peripheral wall 44 inclusive of the tapered regions 49, a main wall (upper wall) 40 and contact pieces 31 each folded back substantially in parallel to the main wall 40 from the lower end of each of the tapered regions 49. The main contact plate 8 has a recess 36 against the vertical wall 3 on the side of the flange 4, a rib relief groove 34 and a collar through-hole 25. The main reinforcement plate 10 is composed of a peripheral wall 46 inclusive of the tapered regions 51 and a body wall (upper wall) 52. Like the main contact plate 8, the main reinforcement plate 10 has a recess 37, a rib relief groove 35 and a collar through-hole 27.

As seen from FIG. 6, on the back side of the flange 4, a pair of positioning grooves 42 and a pair of positioning grooves 43, are recessed from the peripheral portion. When the main contact plate 8 is assembled with the flange 4, the pair of elastic contact pieces 31 of the main contact plate 8 are engaged with the positioning grooves 31. When the reinforcement plate 10 is assembled with the flange 4, the pair of elastic contact pieces 32 of the sub-contact plate 9 are engaged with the positioning grooves 32.

Figure 7B:
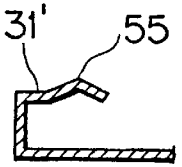
FIG. 7B is a sectional view of another shape of the contact plate 8.
Figure 7A:
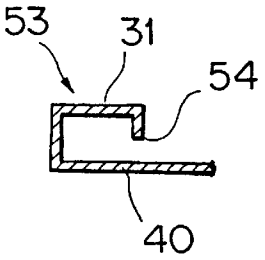
FIG. 7A is a sectional view of the contact plate 8 taken in line B—B in FIG. 6.

As seen from FIG. 7A which is taken in line B—B of FIG. 6, the elastic contact piece 31 and body wall 40 constitute a ]-shaped catching portion 53. In assembling, the catching portion 53 serves to engage the contact plate 8 with the flange 4 provisionally. As seen from FIG. 7A, the elastic contact piece 31 has an integral tip bent inwardly. When the tip 54 is brought into contact with the back surface of the flange 4, the elastic contact piece 31 slightly slants to swell. This assures good contact pressure for the grounding conductor (not shown) on the side of the device 30 (FIG. 2). Therefore, when the elastic contact piece 31 is pressed to be brought into contact with the grounding conductor, the tip 54 is elastically bent so that the elastic contact piece 31 is brought into intimate contact with the grounding conductor.

As shown in FIG. 7B, the intermediate portion of an elastic contact piece 31' may be bent to form a protrusion 55 to be brought into contact with the grounding conductor. In any way, by means of the spring counter force, the elastic contact piece 31, 31', because of their spring force, is brought into contact with the grounding conductor on the side of the device. Therefore, even if the flange is deformed, sufficient contact force can be assured, thereby preventing poor contact. It should be noted that the sub-contact plate 9 also has the same format of the elastic contact piece 31, 31'.

As seen from FIGS. 5 and 6, the sub-contact plate 9 includes a body wall (upper wall) 41, a rear end wall 45 bent at right angles and a pair of elastic contact pieces 32 protruding in parallel to the body wall 41 from the lower end of the rear end wall 45. The body wall 41 has a pair of collar passing-through holes 26. The sub-reinforcement plate 11 is composed of a body wall (upper wall) 56 and a rear end wall 47. The body wall 56 has a pair of collar passing-through holes 28.

As seen from FIG. 5, the sub-contact plate 9 is mounted onto the low level surface of the front half 4*c* of the flange 4 from front as indicated by arrow c. The sub-reinforcement plate 11 is mounted on the sub-contact plate as indicated by arrow d. The upper face (upper wall) 56 of the sub-reinforcement plate 11 is brought into intimate contact with the back surface of the main contact plate 8. These plates can be smoothly assembled with the flange 4 in the order of e.g. sub-contact plate 9, main contact plate 8, main reinforcement plate 10 and sub-reinforcement plate 11.

The sub-contact plate 9 is held by the sub-reinforcement plate 11 and further held by the main reinforcement 10 from above. Therefore, the flange 4 can be brought into intimate contact with the contact plate 8 and 9 and can be strongly reinforced by the reinforcement plates 10 and 11. In addition, since the flange 4 and contact plates 8, 9 are protected by the reinforcement plates 10, 11, the deformation and damage of the shielded connector can be prevented on the way of transportation.

What is claimed is:

1. A shielded connector for direct installation on a device, comprising:

an insulating housing body;

a flange provided to said insulating housing, said flange having opposed first and second principal surfaces;

a first conductive layer deposited on said first principal surface;

a second conductive layer deposited on said second principal surface;

a first conductive contact plate disposed on said first conductive layer, said first conductive contact plate being provided with a first elastic contact piece to be in contact with the device on a side of said second principal surface.

2. The shielded connector according to claim 1, wherein said flange is sandwiched between said first elastic contact piece and said first conductive contact plate so that said first conductive contact plate is provisionally engaged with said flange.

3. The shielded connector according to claim 2, further comprising:

a first conductive reinforcement plate disposed on said first conductive contact plate.

4. The shielded connector according to claim 3, further comprising:

a conductive collar vertically passing through said first reinforcement plate, said first conductive contact plate and said flange in intimate contact, wherein said conductive collar is to be in contact with the device.

5. The shielded connector according to claim 4, further comprising:

a second conductive contact plate disposed on said first conductive layer on said first principal surface side of said flange, said second conductive contact plate being provided with a second elastic contact piece to be in contact with the device on a side of said second principal surface of said flange; and a second conductive reinforcement plate covering said second conductive contact plate, wherein said first conductive contact plate and said first conductive reinforcement plate are assembled with said flange from one of horizontal directions, and wherein said second conductive contact plate and said second conductive reinforcement plate are assembled with said flange from the other of horizontal directions.

6. The shielded connector according to claim 5, wherein said first principal surface of said flange consists of a front half and a rear half which is thicker than said front half to form a level difference at a boundary therebetween, said second conductive contact plate and said second reinforcement plate are stacked on said front half, and said first conductive contact plate and said first conductive reinforcement plate are stacked successively on said rear half and said second reinforcement plate.

7. The shielded connector according to claim 3, wherein said first conductive reinforcement plate is thicker than said first conductive contact plate.

8. The shielded connector according to claim 3, further comprising:

a second conductive contact plate disposed on said first conductive layer on said first principal surface side of said flange, said second conductive contact plate being provided with a second elastic contact piece to be in contact with the device on a side of said second principal surface of said flange; and a second conductive reinforcement plate covering said second conductive contact plate, wherein said first conductive contact plate and said first conductive reinforcement plate are assembled with said flange from one of horizontal directions, and wherein said second conductive contact plate and said second conductive reinforcement plate are assembled with said flange from the other of horizontal directions.

9. The shielded connector according to claim 8, wherein said first principal surface of said flange consists of a front half and a rear half which is thicker than said front half to form a level difference at a boundary therebetween, said second conductive contact plate and said second reinforcement plate are stacked on said front half, and said first conductive contact plate and said first conductive reinforcement plate are stacked successively on said rear half and said second reinforcement plate.

10. The shielded connector according to claim 8, wherein said second conductive reinforcement plate is thicker than said second conductive contact plate.

11. The shielded connector according to claim 5, wherein said second conductive reinforcement plate is thicker than said second conductive contact plate.

12. The shielded connector according to claim 1, further comprising:

a first conductive reinforcement plate disposed on said first conductive contact plate.

13. The shielded connector according to claim 12, further comprising:

a conductive collar vertically passing through said first conductive reinforcement plate, said first conductive contact plate and said flange in intimate contact, wherein said conductive collar is to be in contact with the device.

14. The shielded connector according to claim 13, further comprising:

a second conductive contact plate disposed on said first conductive layer on said first principal surface side of said flange, said second conductive contact plate being provided with a second elastic contact piece to be in contact with the device on a side of said second principal surface of said flange; and a second conductive reinforcement plate covering said second conductive contact plate, wherein said first conductive contact plate and said first conductive reinforcement plate are assembled with said flange from one of horizontal directions, and wherein said second conductive contact plate and said second conductive reinforcement plate are assembled with said flange from the other of horizontal directions.

15. The shielded connector according to claim 14, wherein said first principal surface of said flange consists of a front half and a rear half which is thicker than said front half to form a level difference at a boundary therebetween, said second conductive contact plate and said second reinforcement plate are stacked on said front half, and said first conductive contact plate and said first conductive reinforcement plate are stacked successively on said rear half and said second reinforcement plate.

16. The shielded connector according to claim 14, wherein said second conductive reinforcement plate is thicker than said second conductive contact plate.

17. The shielded connector according to claim 12, further comprising:

a second conductive contact plate disposed on said first conductive layer on said first principal surface side of said flange, said second conductive contact plate being provided with a second elastic contact piece to be in contact with the device on a side of said second principal surface of said flange; and a second conductive reinforcement plate covering said second conductive contact plate, wherein said first conductive contact plate and said first conductive reinforcement plate are assembled on one end portion of said flange directions, and wherein said second conductive contact plate and said second conductive reinforcement plate are assembled with on the other end portion of said flange directions.

18. The shielded connector according to claim 17, wherein said first principal surface of said flange consists of a front half and a rear half which is thicker than said front half to from a level difference at a boundary therebetween, said second conductive contact plate and said second reinforcement plate are stacked on said front half, and said first conductive contact plate and said first conductive reinforcement plate are stacked successively on said rear half and said second reinforcement plate.

19. The shielded connector according to claim 17, wherein said second conductive reinforcement plate is thicker than said second conductive contact plate.

20. The shielded connector according to claim 12, wherein said first conductive reinforcement plate is thicker than said first conductive contact plate.

* * * * *